United States Patent [19]

Wunner

[11] Patent Number: 4,706,475

[45] Date of Patent: Nov. 17, 1987

[54] DEVICE FOR PRESENTING WEFT YARNS TO THE KNITTING NEEDLES OF A WARP KNITTING MACHINE

[75] Inventor: Roland Wunner, Schwerzenbach/Wald, Fed. Rep. of Germany

[73] Assignee: Liba Maschinenfabrik GmbH, Naila, Fed. Rep. of Germany

[21] Appl. No.: 943,674

[22] Filed: Dec. 18, 1986

[30] Foreign Application Priority Data

Sep. 13, 1986 [DE] Fed. Rep. of Germany ..... 3631217

[51] Int. Cl.[4] ..... D04B 23/06

[52] U.S. Cl. ..... 66/84 A

[58] Field of Search ..... 66/84 A, 85 A, 84 R, 66/85 R

[56] References Cited

U.S. PATENT DOCUMENTS 3,756,043 9/1973 Kemter ..... 66/84 A 3,824,811 7/1974 Heilmann et al. ..... 66/84 A

FOREIGN PATENT DOCUMENTS 3343048 6/1985 Fed. Rep. of Germany ..... 66/84 A

*Primary Examiner*—Ronald Feldbaum

*Attorney, Agent, or Firm*—Dority & Manning

[57] ABSTRACT

This invention relates to a warp knitting machine which is equipped with two longitudinal conveyors for conveying weft yarn groups towards a knitting head. The longitudinal conveyors comprise a plurality of hooks for engaging and holding the weft yarns and a weft yarn carriage is provided for laying the groups of weft yarns from one conveyor to the other. Each of the conveyors are provided with a depressing mechanism which includes a depressor which has an inactive position, an intermediate position and a depressing position. Means are provided for moving the depressor from the inactive position to an immediate position extending over a group of weft yarns laid between the hooks on one of the conveyors. Another means is provided for lowering the depressor from the intermediate position to the depressing position to depress the group of yarns into the hooks of the conveyor and for holding them there until the weft yarns are securely engaged in the hooks.

6 Claims, 10 Drawing Figures

DEVICE FOR PRESENTING WEFT YARNS TO THE KNITTING NEEDLES OF A WARP KNITTING MACHINE

BACKGROUND OF THE INVENTION

This invention relates to a device for the laying of weft yarns between two longitudinal conveyors running towards a knitting needle head of a warp knitting machine. The conveyors are equipped with hooks into which the weft yarns presented by a weft yarn carriage are hooked so that the weft yarns, constituting one weft yarn group, and running towards one of the conveyors are pushed temporarily beneath the hooks of a depressor which can be moved into a depressing position to such an extent that the weft yarns cross the shafts of the hooks.

Such a device is known from DE-OS No. 21 29 866. In this published application, a warp knitting machine is described in which depressors are provided on the weft yarn carrriage, each of said depressors being moved downward at the end of the path of travel of the weft yarn carriage by means of limit stops which are attached to the machine frame. The weft yarns running on a given longitudinal conveyor are thereby pushed down by the depressors to such an extent that the weft yarns cross the shafts of the hooks. When the weft yarn carriage reverses its direction of travel after having reached the end of its path of travel, the depressing action exerted on the weft yarns stops practically immediately following this reversal of travel. Since the depressors are activated only in the end zone of the weft yarn carriage's path of travel this activation is relatively short. Together with this laying of the weft yarns in the longitudinal conveyors, whereby the weft yarns cross the shafts of the hooks of said longitudinal conveyors, an insertion into stationary grasping devices located above the longitudinal conveyors also takes place. It is the role of said grasping devices to hold the yarns during the running of the longitudinal conveyors until said longitudinal conveyors have moved across the width of a weft yarn group, whereupon the yarns are transferred by means of dropping devices from the grasping devices into the free hooks of the longitudinal conveyors located below. The dropping devices consist of depressors swinging from the outside in and take effect when the weft yarn carriage, in its travel away from the longitudinal conveyor concerned has reached approximately the middle between the two longitudinal conveyors.

Furthermore, a device for the laying of weft yarns between two longitudinal conveyors running toward a knitting needle head of a warp knitting machine is known from DE-OS No. 20 12 114 in which, as in the object of DE-OS No. 21 29 866, depressors are installed on the weft yarn carriage and are activated in the same manner and for the same length of time as is the case with the object of DE-OS No. 21 29 866. Also in the device according to DE-OS No. 20 12 114, the insertion of the weft yarns into the hooks of the longitudinal conveyors is accompanied by a hooking into a further element, i.e. into an offset rake which moves counter to the running direction of the longitudinal conveyors up to the adjoining group of free hooks on the longitudinal conveyor and are then shifted together with the longitudinal conveyor, whereby the transfer of the yarns from the offset rake to the hooks of the longitudinal conveyor takes place during this shift because of the appropriate configuration of the offset rake and the hooks. In the device according to DE-OS No. 20 12 114 therefore, the dropping devices provided in the object of DE-OS No. 21 29 866 can be dispensed with.

SUMMARY OF THE INVENTION

Based on the state of the art discussed above, it should therefore be remembered that the weft yarns running on one of the longitudinal conveyors must be securely accepted by the hooks of this longitudinal conveyor. The depressors installed on the weft yarn carriage serve that purpose, although their effectiveness, because their location on the weft carriage is concentrated only upon the relatively short time period of the weft yarn carriage's movement at the end of its path of travel. The desired reliability with which the weft yarns are accepted by the hooks of the longitudinal conveyors becomes especially questionable when the weft yarn carriage is moved at a relatively high speed from one longitudinal conveyor to the other.

An object of the instant invention is to fashion the device for the laying of weft yarns between two longitudinal conveyors running toward a knitting needle head of a warp knitting machine so that the reliability with which the hooks of said longitudinal conveyor accept the weft yarns running on their respective conveyor is improved. This is achieved by providing stationary depressors next to the path of the weft yarn carriage and between the longitudinal conveyors, adjoining the latter in their starting position. The depressors are held temporarily in the depressing position which reaches over the respective group of weft yarns until the weft yarn carriage guides the running weft yarns at a slight inclination in relation to the weft yarn plane.

In this design of the device, the depressors are thus not installed on the weft yarn carriage but are supported in a stationary position, constituting a structural element independent of the weft yarn carriage. This makes it possible to keep the depressors in depressing position when the weft yarn carriage has already moved away from the longitudinal conveyor after having taken over the weft yarns from the hooks of said conveyor. Thus, the weft yarns of a weft yarn band are kept in depressed position for a relatively long period of time after being hooked into the hooks of a longitudinal conveyor, so that there is no longer a tendency for the inserted weft yarns to slip off the hooks. As the distance between the weft yarn carriage and the longitudinal conveyor concerned increases, the weft yarns hooked in its hooks are at an ever decreasing angle to the plane of the weft yarns hooked in on both sides (weft yarn plane), and this keeps the weft yarns from slipping off the hooks of their longitudinal conveyor. If the depression of the weft yarns stops when the position of the weft yarn carriage is such that it is still in the zone of its end of path of travel (as is the case in the state of the art discussed above), the weft yarns run away from the hooks relatively steeply in relation to the weft yarn plane, i.e. at a wide angle, creating a tendency to slide off the hooks.

An appropriate design for the passage of the depressors from their starting position to the depressing position consists in fashioning the depressors so that they can be shifted, at each end of the weft yarns carriage's path of travel, into an intermediary position which reaches over the group of weft yarns concerned and from which the depressors can be moved vertically into the depressing position which inserts the weft yarns under the hooks of the longitudinal conveyor. The movement of the depressors is then divided into two steps, i.e. from the starting position into the intermediary position and then from the intermediary position, by vertical movement, into the depressing position, whereby an easy-to-survey sequence of movements, representing good design, is achieved.

One design possibility consists in fashioning the depressors in the form of rods and to locate them in a starting position alongside the weft yarn group, next to and above it, from which they can be moved into the intermediary position by swivelling around an axis supported perpendicularly to the plane of the weft yarn group, and into the depressing position by sliding them in the direction of the axis. The depressors made in the shape of rods, first execute a swivelling motion from their starting position, in which they are aligned alongside the weft yarn group, into the intermediate position in which they then reach over the weft yarn group. By sliding them in the direction of the swivelling axis and into their depressing position, the depression of the weft yarns is obtained.

Another design possibility consists in bringing the rod-shaped depressors which lie crosswise to the weft yarn group, next to and above these yarns, into their depressing position by shifting them in a direction perpendicular to their longitudinal movement. In this case, the depressors, in their starting position, are arranged crosswise to the weft yarn group but next to it and above it, so that the longitudinal shift of the depressors into the intermediate position causes them to reach over the weft yarn group, whereupon, the shift in a perpendicular direction to the longitudinal movement takes place, so that the depressing position is finally reached.

The device described above can be equipped with or without offset rakes, either of which possibilities is known. If offset rakes are provided, the device allows for the laying of the weft yarns, as a so-called parallel weft, in which all of the weft yarns lie at the same distance next to each other and parallel to each other. However, if the device is not equipped with an offset rake, the weft yarns are laid in a so-called cross-weft, i.e. an overlap next to the longitudinal conveyors results, where the overlapping weft yarn groups lie at an angle to each other. In either case, the depressors have the effect described earlier. If offset rakes are provided, the depressing position is lowered so far in relation to the weft yarn plane that the offset rakes are crossed by the weft yarns together with the hooks of the longitudinal conveyors. In this instance the offset rakes assume their operating position in which they take along the weft yarns as they shift in a manner known. The offset rakes can be adjusted here in relation to the depressing position so that in addition to their operating position they can also assume an inactive position in which the offset rakes lie beneath the weft yarns so that the weft yarns cannot get into the offset rakes even when they are in depressed position. This makes it possible to achieve the laying of parallel weft as well as of cross weft with devices that are equipped with offset rakes.

Preferably, the offset rakes are then arranged so that they can be shifted at will from their operating position into their inactive position and back.

BRIEF DESCRIPTION OF THE DRAWINGS

The invention will be better understood by reference to the accompanying drawings, in which.

DETAILED DESCRIPTION OF THE INVENTION

The following figure description is based on the state of the art according to the above-mentioned DE-OS No. 20 12 114. The design principle of the installation for the laying of transverse weft yarns to be knitted by a warp knitting machine is contained in that publication, so that details given by said publication can be omitted in this text.

Figure 1:
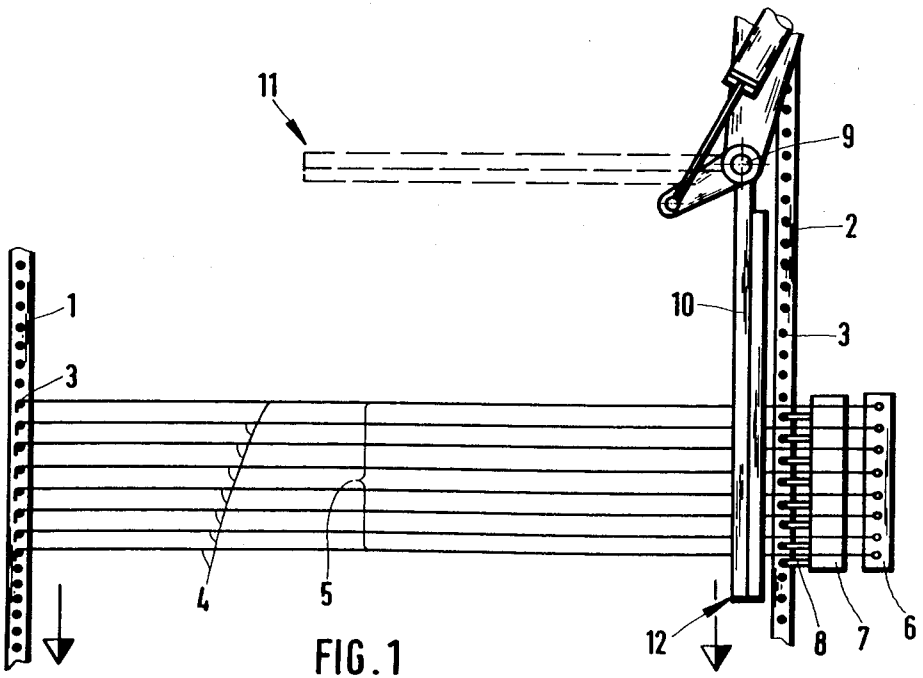
FIG. 1 is a schematic plan view of two longitudinal conveyors for a warp knitting machine with a weft yarn group extending over both of the conveyors and illustrating a depressor capable of being swivelled about an axis.

FIG. 1 shows the two longitudinal conveyors 1 and 2 of a warp knitting machine advancing in the direction of the knitting elements of said warp knitting machine in a known manner. The hooks 3 of the two longitudinal conveyors 1 and 2 of FIG. 1 are represented schematically here by the dots drawn in on the longitudinal conveyors 1 and 2. A weft yarn group 5, consisting of eight weft yarns 4, extends between the two longitudinal conveyors 1 and 2. It should be pointed out here that such a weft yarn group normally contains a considerably greater number of weft yarns, e.g. 24 weft yarns. The weft yarn group 5 is laid down by the weft yarn carriage 6 in a known manner, said weft yarn carriage 6 being shown in FIG. 1 at the end of its laying movement over longitudinal conveyor 2. From the position shown, the weft yarn carriage 6 reverses its course.

FIG. 1 also shows the offset rake 7 with its raking teeth 8, which serve as is known, to take up the weft yarns 4 and to shift them before the return of the weft yarn carriage 6 at a parallel so that all weft yarns follow each other at a same distance. This will be discussed in greater detail in the description of FIG. 3.

FIG. 1 also shows the depressor 10, which can be swivelled around axis 9, and which serves to depress the weft yarns 4 sufficiently for the weft yarns 4 to cross the shafts of the hooks 3 of longitudinal conveyor 1 or 2. The depressor 10 is installed in a stationary position next to the travelling path of the weft yarn carriage 6 (see also FIGS. 6 and 7). In its starting position 11, the depressor 10 does not influence the weft yarns 4 because of the travel direction of the longitudinal conveyors 1 and 2, indicated by the arrows. It points in a direction which is nearly parallel to the weft yarns 4 (see starting position 11, indicated by dotted lines), from which direction it can be swivelled into the intermediate position 12, represented by solid lines, in which it reaches over the weft yarn group. From this intermediate position the depressor 10 is then moved into the depressing position 13, as is to be explained in FIG. 2.

Figure 2:
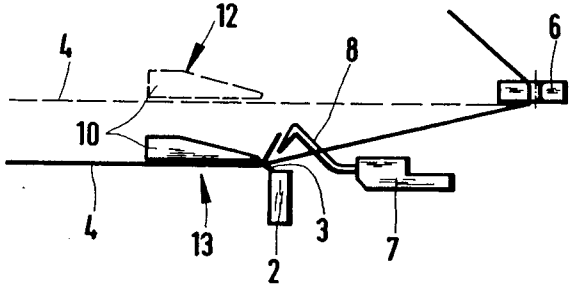
FIG. 2 is a schematic end view of the warp knitting machine illustrated in FIG. 1, showing the level of the depressors.

In FIG. 2, the arrangement of FIG. 1 is represented from its end, i.e. looking into the plane of the weft yarn 5 and crosswise to same. In FIG. 2, depressor 10 is drawn in solid lines and is shown in depressing position 13, into which it has been shifted after having swivelled from the starting position 11 and vertically over the intermediary position 12. Here, depressor 10 depresses the weft yarns 4, shown first in their higher position by dotted lines, into the position of the weft yarns 4 which is represented by solid lines, in which they cross the shafts of the hooks 3 on the longitudinal conveyor 2. The descending movement of the depressors 10, from the intermediate position 12 into depressing position 13 brings the weft yarns 4 over which the depressor 10 reaches within range of the hooks 3. At the same time the depressed weft yarns 4 also cross the rake teeth 8 of the offset rake 7.

In this position of the depressors 10 and of the weft yarn carriage 6, the offset rake 7 is now shifted parallel to the longitudinal conveyor 2 and counter to its direction of travel and by the width of one yarn group 5, where each of the weft yarns 4 is hooked into its hook 3 and into the offset teeth 8. The weft yarn carriage 6 then reverses its direction of travel and runs across longitudinal conveyor 2 in the direction of the other longitudinal conveyor 1, and this is to be described through FIG. 3.

Figure 3:
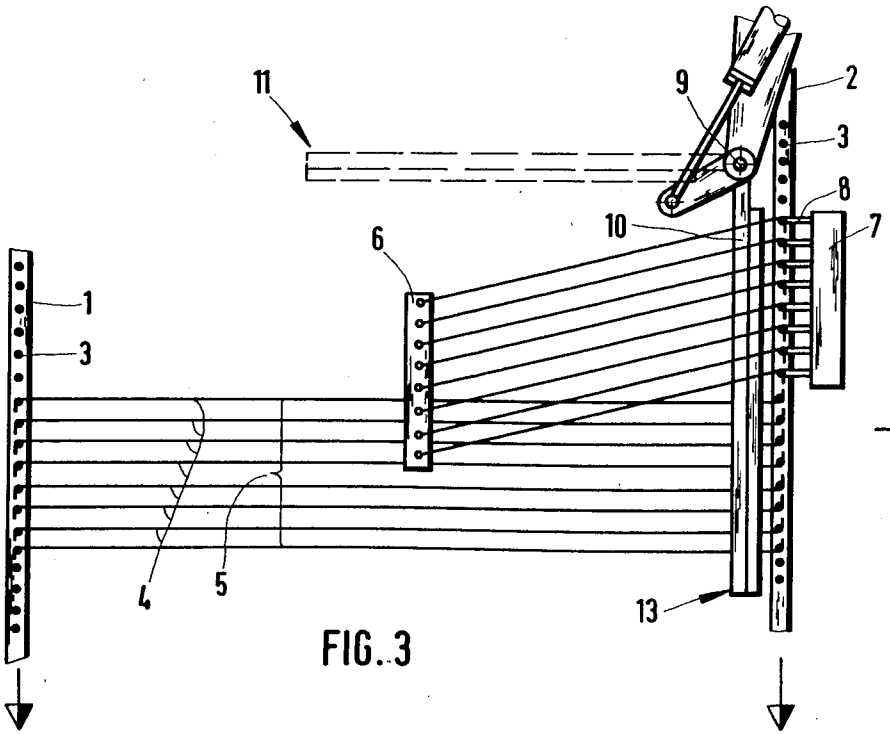
FIG. 3 is a schematic plan view similar to FIG. 1, showing continued yarn guidance from the position of the weft yarn carriage in FIG. 1 to a point where the weft yarn carriage is halfway between the two longitudinal conveyors.

FIG. 3 shows the arrangement of FIGS. 1 and 2, but with the weft yarn carriage 6 having moved to the center between the longitudinal conveyors 1 and 2 and with the offset rake 7 in its offset position. In this operating phase the depressor 10 is still in its depressing position 13.

Figure 4:
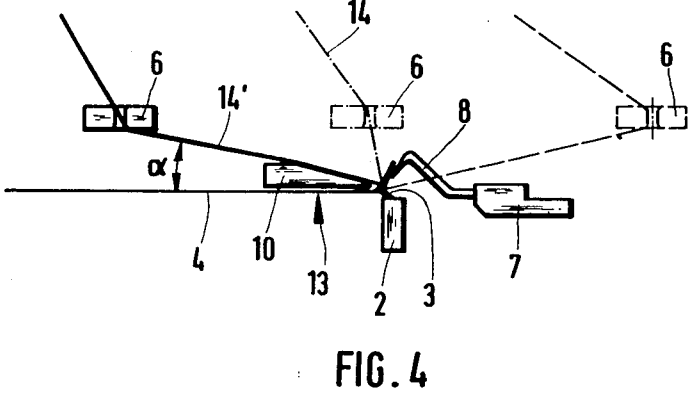
FIG. 4 is an end view of the warp knitting machine shown in FIG. 3.

FIG. 4 now shows the processes which then occur in the area of the longitudinal conveyor 2. In FIG. 4, the position of the weft yarn carriage 6 according to FIG. 1 is shown in dotted lines, and according to FIG. 3 in solid lines. In addition, lines consisting of dots and dashes indicate an intermediate position in which the weft yarn carriage 6 is approximately above the longitudinal conveyor 2. From this drawing it can be seen that the weft yarns 14 running through the weft yarn carriage 6 go from a position slanted to the right, through a vertical position and into a position slanted to the left, with little inclination in relation to the weft yarn plane. The angle of inclination is designated by in FIG. 4. During this transition, the yarns 14 slide off from the rake teeth 8 in a known manner toward the corresponding hooks 3 of the longitudinal conveyor 2, until yarn 14' finally assumes the position with little inclination in relation to the weft yarn plane, mentioned earlier, in which it loops around the hooks 3 in such a way that it cannot slip off these hooks. At the same time the depressor 10 which is still in depressing position 13 ensures that the yarns 4 are held between the hooks 3 for a relatively long period of time, i.e. until the yarns 14' can assume the above-mentioned slanted position with little inclination. This ensures that the yarns 4 or 14' can be held very securely by the hooks 3 thanks to the relatively long duration of the depressing action of the depressor 10, even at high travelling speeds of the weft yarn carriage 6.

Figure 5:
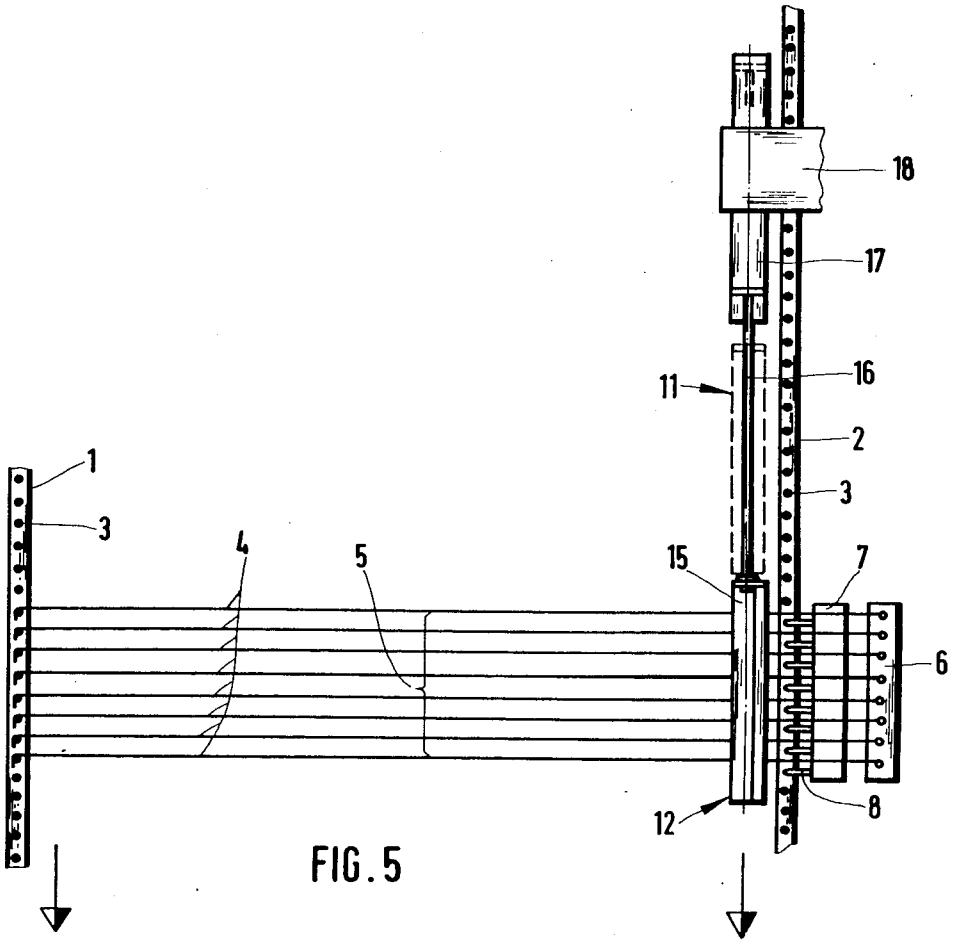
FIG. 5 is a schematic plan view of another embodiment of the depressor designed to move in a longitudinal direction.

FIG. 5 shows another embodiment of the depressor. According to FIG. 5, the depressor 15 can be shifted longitudinally and is attached to the end of the piston rod 16 for that purpose, said piston rod being shifted back and forth pneumaticaly or hydraulically by cylinder 17. Cylinder 17 is attached to the holder 18. The rod-shaped depressor 15 is moved from the starting position 11, shown in dotted lines, into the intermediary position 12. Because of the arrangement of the depressor 15 in the starting position, crosswise to the weft yarn group 5, next and and above the latter, said weft yarn group 5 is not disturbed in the starting position 11. The depressor 15 is then moved by vertical shifting from the intermediate position 12 into depressing position 13 (see FIG. 2), and this is to be discussed in further detail through FIGS. 8 and 9. In either case, the resulting positions of yarns 4 are the same as those shown in FIG. 2.

Figure 6:
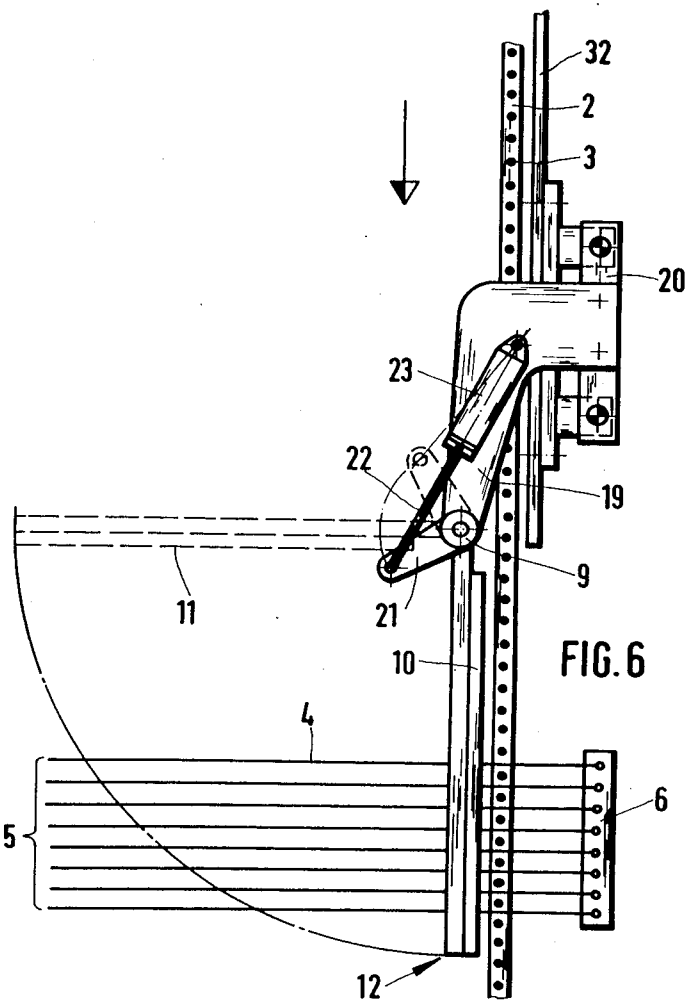
FIG. 6 is a schematic plan view of the warp knitting machine of FIG. 1, illustrating the rotational mobility of the depressor.
Figure 7:
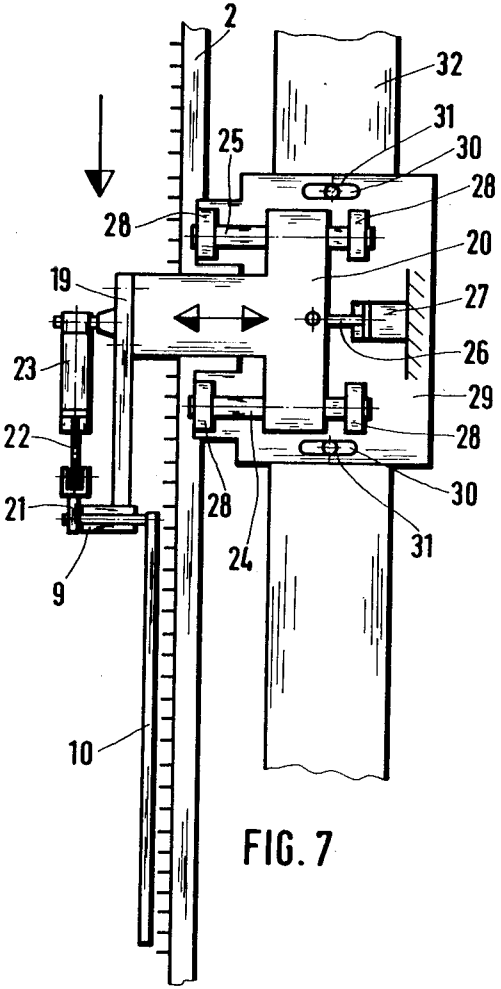
FIG. 7 is a side view of the depressor and carriage shown in FIG. 6.

FIG. 6 shows the moving mechanism for the depressor of FIG. 1 in further detail. Axle 9 is attached to the end of arm 19 which extends over the longitudinal conveyor 2 and the bearings of which are supported on the machine frame above the sliding piece 20. On the axle 9 sits the extension arm 21 to the end of which the ram 22 of the piston cylinder unit 23 is linkingly connected, said piston cylinder unit being, in turn, linkingly connected to arm 19 by its end away from ram 22. When the piston cylinder unit 23 is activated, axle 9, and with it the depressor 10 are swivelled accordingly. In this swivelling motion, the depressor 10 then moves from starting position 11 into intermediate position 12.

Now, to be able to transfer the depressor from intermediate position 12 into depressing position 13 (see FIG. 2), the sliding piece 20 is supported on bearings at both ends on longitudinal guides 24 and 25, which ensure a straight-line shifting of the sliding piece 20 and at the same time the vertical movement of the depressor 10. The sliding piece 20 is moved back and forth through the piston cylinder unit 27 by means of the ram 26. The two longitudinal guides 24 and 25 are each supported on bearings in two supports 28 which are attached to plate 29. Plate 29 is, in turn, slidingly attached to the tie-bar 32 of the machine frame by means of the long holes 30 and the attachment screws 31.

Figure 8:
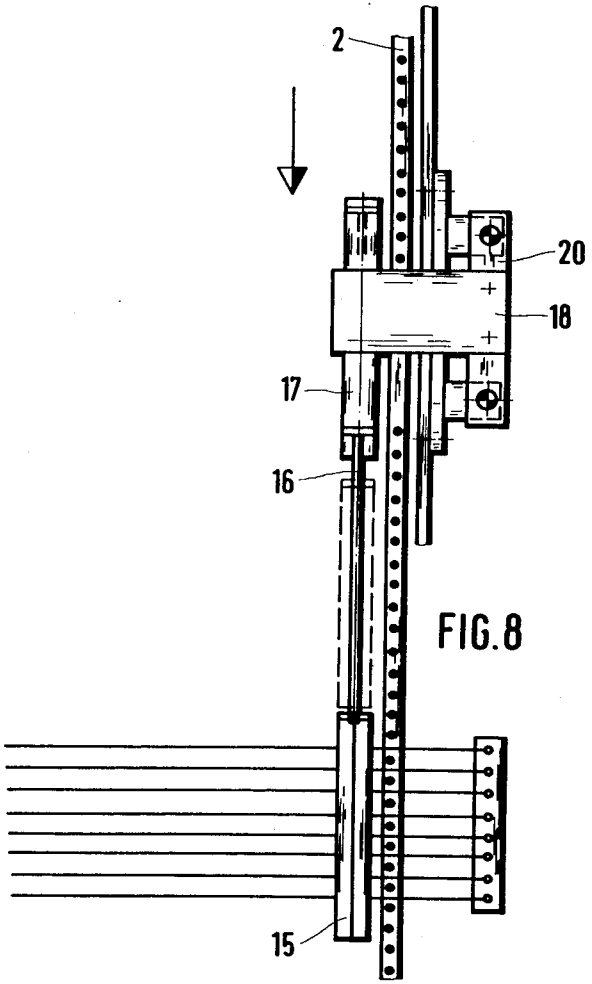
FIG. 8 is a schematic plan view of the embodiment of the invention shown in FIG. 5, illustrating the longitudinal mobility of the depressor.
Figure 9:
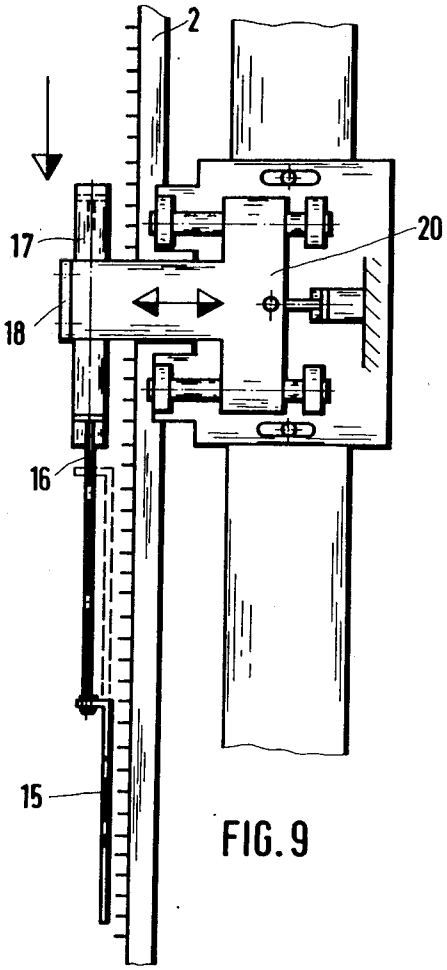
FIG. 9 is a side elevation of the conveyor and the depressor illustrated in FIG. 8.

The following is a description, through FIGS. 8 and 9, of the moving mechanism for the depressor 15 of FIG. 5. The piston cylinder unit 17 shown in FIG. 5 is attached to the holder 18 which is, in turn, attached to the sliding piece 20. The sliding piece 20 is installed in the same manner as the same sliding piece of FIGS. 6 and 7, so that the description for FIGS. 6 and 7 can serve for its attachment and movement. The moving mechanism for longitudinal shifting of the depressor 15 has already been discussed above in connection with FIG. 5.

Figure 10:
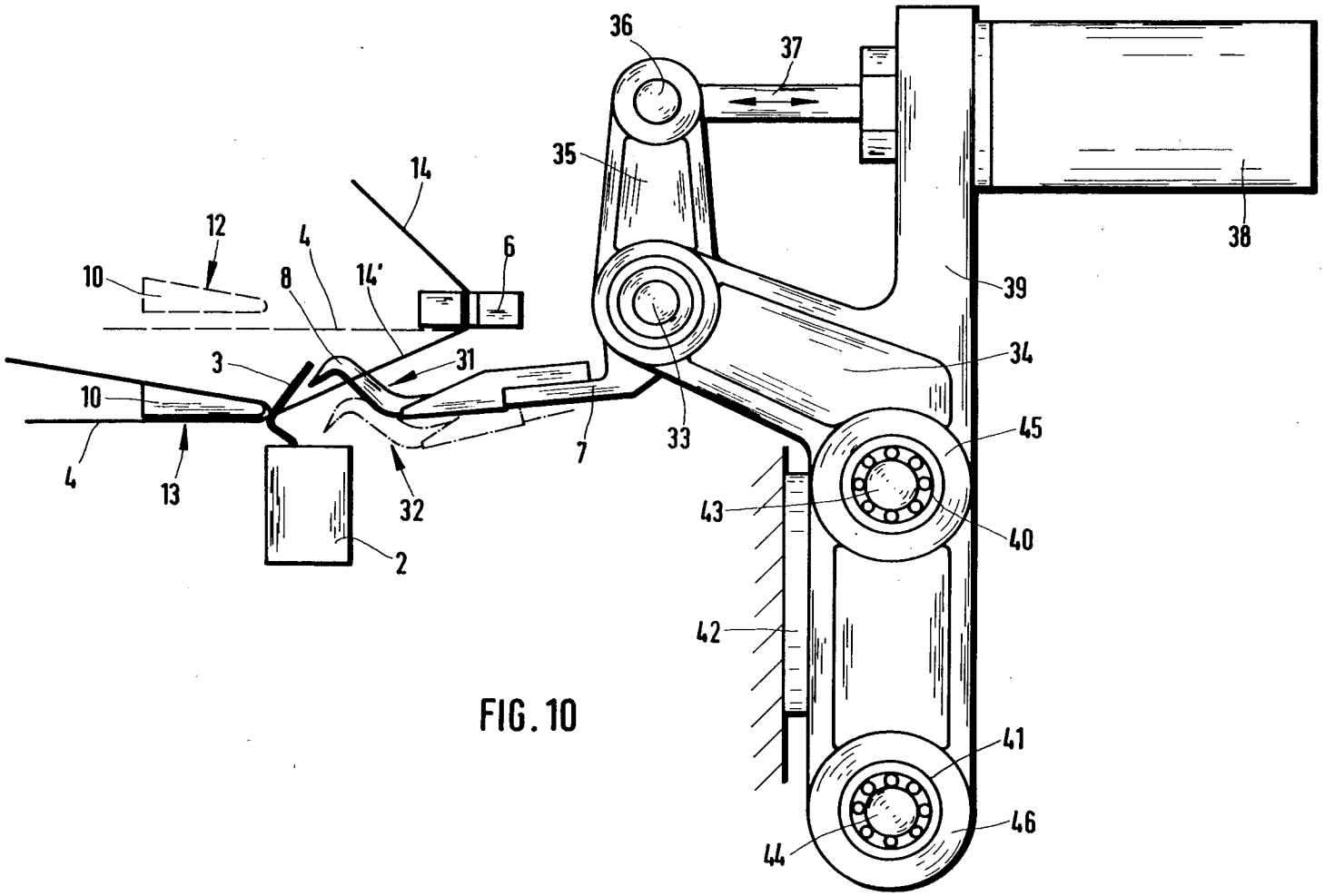
FIG. 10 is an end view of the mechanism supporting the offset rake illustrating means for moving said rake from an active to an inactive position.

FIG. 10 shows the device with an offset rake capable of being set to an operating position 31 and to inactive position 32, whereby the left portion of FIG. 10 is essentially the same as FIG. 2, i.e. FIG. 10 also shows the depressor 10 in the intermediate position 12 and in the depressing position 13. The offset rake 7 is rotatably and linkingly connected via axle 33 to a bearing arm 34 and is extehded beyond axle 33 into the extension arm 35 at the end of which the ram 37 of the piston cylinder unit 38 begins at axle 36. The piston cylinder unit 38 is attached to the bearing arm 34 via support 39. As the ram 37 is pushed out or pulled in, the extension arm 35 is swivelled, causing the rake teeth 8 to assume either operating position 31 or inactive position 32. In the inactive position, the rake teeth lie so far below the yarns 14' which are hooked into the hooks 3, that the rake teeth 8 have no influence upon the yarns 14', even during shifting of the offset rake 7 (see the drawing of the inactive position 32, represented by dots and dashes). If the rake teeth 8 are in operating position 31, however, (represented by solid line drawing), the rake teeth 8 reach over the weft yarns 14' and take them along when the offset rake 7 is shifted in the manner shown in FIG. 3. Selective setting of the piston cylinder unit 38 makes it possible for the device to lay cross wefts (inactive position 32) or parallel wefts (operating position 31), whereby the depressors 10 remain fully effective for the hooks of longitudinal conveyor 2. The offset rake 7 could also be omitted, and the device would then lay cross wefts.

FIG. 10 furthermore shows the spherical liners 40, 41 used for the longitudinal shifting of the offset rake 7 and which are supported on the shafts 43 and 44, attached to the machine frame 42 and which impart the longitudinal mobility required for the shifting of the offset rake to the hubs 45 and 46, which are pulled over them. Hubs 45 and 46 are components of the bearing arm 34 which is extended via said hubs 45 and 46.

It will be understood, of course, that while the form of the invention herein shown and described constitutes preferred embodiments of the invention, it is not intended to illustrate all possible forms of the invention. It will also be understood that the words used are words of description rather than of limitation and that various changes may be made without departing from the spirit and scope of the invention herein disclosed.

What is claimed is:

1. In a warp knitting machine having two longitudinal conveyors for conveying weft yarns towards a knitting head, said conveyors comprising a plurality of hooks for engaging said weft yarns; and a weft yarn carriage for laying groups of weft yarns from one conveyor to the other; the improvement comprising:

(a) a depressor having an inactive position, and intermediate position and a depressing position;

(b) means for moving said depressor from said inactive position to said intermediate position, extending over a group of weft yarns laid between the hooks on one of said conveyors;

(c) means for lowering said depressor from said intermediate position to the depressing position to depress said group of weft yarns into the hooks of said conveyor after said weft yarn carriage has positioned said group of weft yarns over said conveyor; and (d) means for moving said depressor to said inactive position after said weft yarn carriage has moved past said depressor towards the other conveyor and said weft yarns held by said depressor have been hooked into the hooks of said one conveyor.

2. A warp knitting machine as set forth in claim 1, wherein the depressor is shifted momentarily at the end of the path of travel of the weft yarn carriage into said intermediate position in which said depressor reaches over a group of weft yarns and wherein said depressor is movable from said intermediate position vertically into the depressing position for pressing the weft yarns into the hooks of the longitudinal conveyor.

3. A warp knitting machine as set forth in claim 2, wherein the depressor is rod-shaped and lies alongside, next to and over the weft yarn group in its starting position from which it can be moved into said intermediate position by swivelling about an axle supported perpendicularly to the plane of the weft yarn group and into the depressing position by shifting the depressor perpendicularly to its longitudinal sense.

4. A warp knitting machine as set forth in claim 2, wherein the depressor is rod-shaped and lies crosswise to the weft yarn group, next to and over the weft yarns in its starting position, from which it can be moved into the intermediate position through longitudinal shifting and into the depressing position through a shift that is perpendicular to its longitudinal sense.

5. A warp knitting machine as set forth in claim 1, wherein offset rakes are provided next to the longitudinal conveyors and the depressing position of said depressor is sufficiently lower than the weft yarn plane for the offset rakes to come to lie underneath the weft yarns in an inactive position and to be crossed by the weft yarns together with the hooks of the longitudinal conveyors when they are in their operating position.

6. A warp knitting machine as set forth in claim 5, wherein the offset rake can be selectively shifted from an operating position into an inactive position and vice-versa.

* * * * *